United States Patent [19]

Huebschmann et al.

[11] 3,991,708

[45] Nov. 16, 1976

[54] GRAVURE-TYPE ADHESIVE APPLICATOR

[75] Inventors: John W. Huebschmann, Youngstown; H. Dean Packard, Lewiston; William D. Swiercz, Lakeview, all of N.Y.

[73] Assignee: Moore Business Forms, Inc., Niagara Falls, N.Y.

[22] Filed: June 23, 1975

[21] Appl. No.: 589,131

[52] U.S. Cl. ..... 118/44; 118/202; 118/212; 118/247; 118/258

[51] Int. Cl.[2] ..... B05C 1/08

[58] Field of Search ..... 118/44, 212, 247, 258, 118/202; 101/23

[56] References Cited

UNITED STATES PATENTS

| | | | |
|---|---|---|---|
| 2,168,229 | 8/1939 | MacArthur | 101/248 X |
| 2,746,387 | 5/1956 | Neumann | 101/23 X |
| 2,787,244 | 4/1957 | Hickin | 118/212 X |
| 2,838,416 | 6/1958 | Babiarz et al. | 118/44 X |
| 2,911,942 | 11/1959 | Gross | 118/212 X |
| 3,379,171 | 4/1968 | Cordingly et al. | 118/261 |

*Primary Examiner*—John P. McIntosh

*Attorney, Agent, or Firm*—Watson, Cole, Grindle & Watson

[57] ABSTRACT

An adhesive applicator of the gravure-type is provided for continuously applying spots of adhesive onto a travelling web with the use of a roller of the intaglio type. A filling device having a spring loaded shoe element bearing against the roller fills the cavities of the roller with adhesive under pressure from a closed adhesive reservoir. The web is moved by a pin wheel disposed adjacent the roller, and spots of adhesive from the filled cavities are continuously applied to the web as it is intermittently forced to track the applicator roller by means of spaced pads provided on the wheel.

3 Claims, 4 Drawing Figures

GRAVURE-TYPE ADHESIVE APPLICATOR

BACKGROUND OF THE INVENTION

This invention relates generally to an adhesive applicator, and more particularly to such an applicator which makes use of a roller of the intaglio type for effecting continuous application of spots of adhesive onto a moving web.

Various approaches have in the past been used in applying spots of adhesive onto moving webs such as paper to serve as a securing means in lieu of glue streams. Among these are such devices wherein resilient pads are wetted for the spot application of glue as the pads contact an adhesive transfer roll. Also, protruding pads on a web backup roll of another device effects glue spot application as portions of the roll are made to thereby intermittently contact an applicator roll. Another approach taken in applying glue spots is with the use of a roller of the intaglio type having its cavities filled with adhesive by means of an adhesive fountain or glue pot. However, in each of these prior art developments as shown by U.S. Pat. Nos. 3,092,513 and 2,787,244, applicator and fountain rolls must be used or a glue fountain is required to carry out the spot glue application. More importantly, the speed capability of these devices are limited because of their inherent inability for adequately controlling the amount of spot glue during application. Moreover, these prior art devices are generally cumbersome and relatively complex because of the paricular techniques used in carrying out the spot glue applications.

SUMMARY OF THE INVENTION

It is therefore an object of this invention to avoid the many drawbacks noted among the prior art devices by providing a gravure-type adhesive applicator capable of continuously applying spots of adhesive along a moving web more quickly, more efficiently and in a highly economical manner.

Another object is to provide such an applicator in which a rotatable wheel supports the web adjacent an intaglio roll, and a plurality of resilient pads are provided on the wheel beneath the web so that portions of the web are forced into the cavities of the roll to thereby extract spots of adhesive therefrom.

In summary, the gravure-type adhesive applicator according to the invention includes a roller of the intaglio type, means for filling the cavities on such roller with adhesive, and a rotatable wheel supporting the web for continuous movement. Spaced resilient pads are provided on the wheel beneath the web to intermittently force portions of the web into the adhesive filled cavities of the roller so as to thereby extract a controlled portion of adhesive therefrom.

Other objects, advantages and novel features of the invention will become more apparent from the following detailed description of the invention when taken in conjunction with the accompanying drawings.

DESCRIPTION OF THE PREFERRED EMBODIMENT

Figure 1:
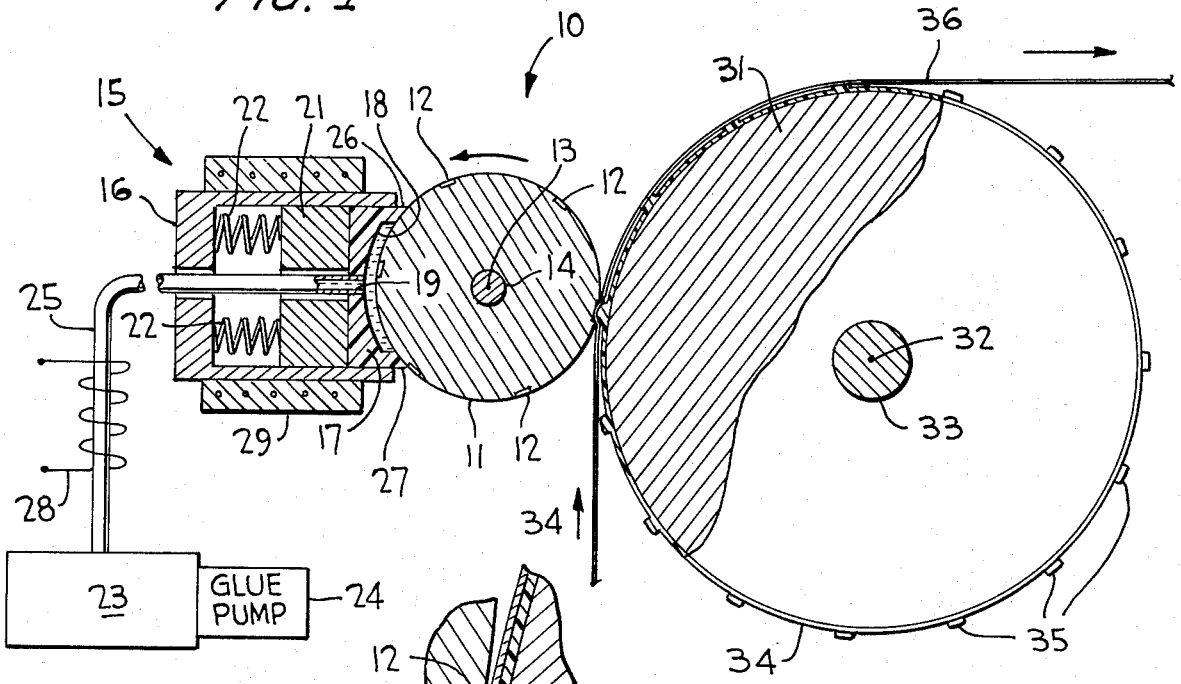
FIG. 1 is a side-elevational view partly in section showing the details of the adhesive applicator in accordance with the present invention.
Figure 3:
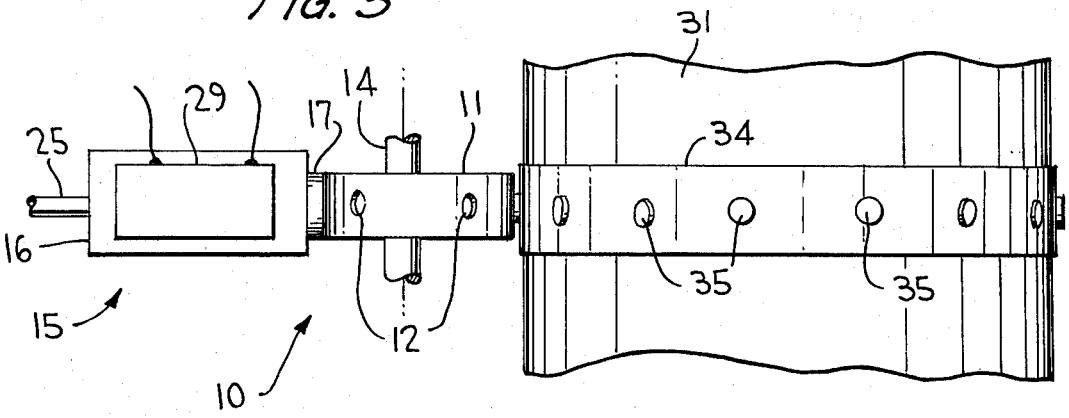
FIG. 3 is a top plan view of the applicator of FIG. 1.

Turning now to the drawings wherein like reference characters refer to like and corresponding parts throughout the several views, the adhesive applicator is generally designated 10 in FIGS. 1 and 3 and includes a cylindical roller 11 of the intaglio type having a plurality of spaced cavities 12 provided along the periphery thereof. Roller 11 is mounted for rotation about its central axis 13 in any normal manner, the roller being supported on its central axle 14 located within suitable bearings for rotation in any normal manner in the direction of the roller arrow shown in FIG. 1.

An adhesive feeding device is generally designated 15 and includes a housing 16 having an open side facing roller 11 and otherwise closed at its remaining sides. A shoe-element 17 is disposed within the housing and extends slightly outwardly of its open end, such element having a concave outer end of a curvature of approximately the same as that of cylindrical roller 11. The shoe element is also provided with an elongated recess 18 at its concave end, and a central opening 19 extending between this cavity and the rear face of the shoe element. A bearing block 21 rests against the back face of the shoe element within the housing, and spring means such as coil springs 22 within the housing serve to resiliently urge block 21 and the shoe element in a direction toward roller 11.

A quantity of adhesive in a supply reservoir 23 is forced therefrom by means of a pump 24 through an outlet tube 25 which extends into the housing, through block 21 and is disposed within opening 19 of the shoe element. Accordingly, adhesive may be pumped into recess 18 for filling same under pressure within a range designed for the pump of approximately 5 – 20 psi. Therefore, during rotation of roller 11, its cavities 12 move through the adhesive filled recess of the shoe element and, by reason of the pressure feed of the adhesive, each cavity is filled with adhesive as they are moved away from recess 18. It can be seen that, with the concave construction of the shoe element, its upper and lower extremities 26 and 27, being complementary to the curvature of roll 11, provide an effective seal which precludes escape of the adhesive from recess 18. Also, upper extremity 26 serves to scrape any undesired built-up of adhesive from the periphery of the roll, and lower extremity 27 acts in the manner of a rigid doctor blade for the adhesive-filled cavities. With such an arrangement for the feeding device shoe element 17 may be replaced by one having a different concavity complementary to a differently sized cylindrical roll 11.

Also, the feeding device for the present applicator is adaptable for use with a hot melt adhesive and, because of its compact and relatively simple construction, feed tube 25 may be wrapped by a suitable resistance heating element 28, and the housing may be surrounded by a heating pad such as 29. Accordingly, each of the elements of the feeding device may be easily and effectively heated so as to elevate the temperature of the adhesive to such a level which renders it easy to spot apply.

The present applicator further includes a pin wheel or cylinder 31 mounted for rotation about its central axis 32 lying parallel to axis 13 of the roller. Wheel 31 is supported on its central axle 33 which is mounted in suitable bearings and is rotated by some means, not shown. A non-metallic band 34 is provided along the periphery of the cylinder, and has a plurality of spaced resilient pads 35 thereon. These pads are spaced apart a distance substantially equal to the spacing between cavities 12 of the roller, and each pad has an outer dimension slightly larger than the outer dimension of each cavity as clearly shown in FIG. 2. Also shown in that FIGURE is the height dimension of a typical pad 35 which is slightly thicker than the depth of a typical cavity.

Figure 2:
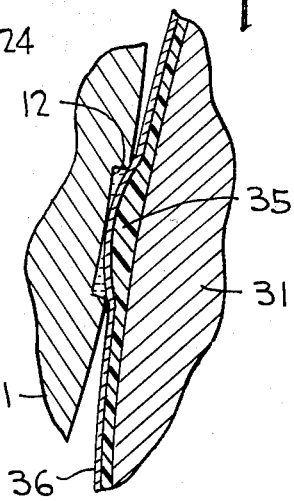
FIG. 2 is an enlarged sectional view showing a portion of a cooperating cavity and pad between the roll and the wheel and the manner in which a web portion is forced into such cavity.
Figure 4:
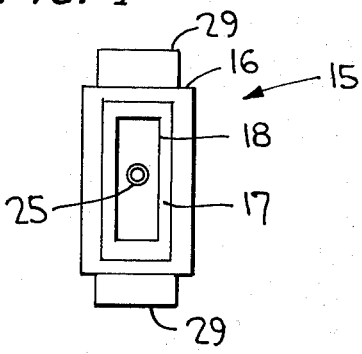
FIG. 4 is a side-elevational view of the feed device of FIG. 1.

A web 36 of paper material or the like is supported by cylinder 31 and passes between the nip of roller 11 and the cylinder as clearly shown in FIGS. 1 and 2. Of course, the web overlies band 34 and pads 35 so that, during rotation of the roller and the cylinder, spaced portions of the web are intermittently forced into the cavities for extracting spots of adhesive therefrom as the pads engage the cavities.

The wheel may have feed pins thereof cooperating with feed holes in the web (not shown) for feeding the web in the direction of its arrows shown in FIG. 1, as is customary in this art.

From the foregoing, it can be seen that only a controlled amount of adhesive is continuously spot applied to the web with such an arrangement which permits a higher speed application of glue spots than with the use of prior art devices. The roller and the cylinder are driven together in synchronism by some suitable means and may be replaced by differently sized cooperating rollers and wheels and a correspondingly sized shoe element without departing from the teachings of the invention. Band 34 is easily replaceable when the need arises because of wear of the pads or any deterioration of the band itself. The entire pin wheel therefore need not be replaced. Also, the applicator of the invention is not only of a compact construction but makes use of a closed reservoir for the adhesive thereby avoiding any need for fountain or applicatorrollers otherwise required. And, because the pads are not wetted themselves by adhesive, any adhesive build up of the pads is completely avoided and the overall use of adhesive is substantially reduced because of the controlled amounts of adhesive applied. Webs of various widths may be glue spotted with the present applicator with no requirement for adjustment.

Obviously many other modifications and variations of the invention are made possible in the light of the above teachings. It is therefore to be understood that within the scope of the appended claims the invention may be practiced otherwise then as specifically described.

What is claimed is:

1. A gravure-type adhesive applicator, comprising:

a roller of the intaglio-type having a plurality of spaced cavities provided along the periphery thereof, said roller being mounted for rotation about a central axis thereof, and said cavities comprising depressions having substantially flat bottoms;

an adhesive feeding device mounted circumferentially of said roller for filling said cavities with adhesive during rotation of said roller;

a wheel disposed adjacent said roller, said wheel being mounted for rotation about a central axis thereof parallel to said roller axis for moving a web supported by said wheel upon rotation thereof; and a continuous non-metallic band removably disposed about the periphery of said wheel, said band having a plurality of resilient pads spaced therealong and extending radially outwardly thereof beneath the web, said pads being spaced apart a distance equal to the spacing of said cavities, each of said pads having an outer dimension slightly larger than the outer dimension of each of said cavities, and the thickness of each of said pads being slightly greater than the depth of each of said depressions, whereby, during rotation of said roller and said wheel, spaced portions of the web are intermittently forced into said cavities for extracting spots of adhesive therefrom to thereby spot wet said web with adhesive spots comparably sized to that of said depressions.

2. The adhesive applicator according to claim 1, wherein said feeding device comprises a housing containing a shoe element bearing directly against the peripheral surface of said roller, a recess in said shoe element communicating with a supply of adhesive, and spring means within said housing resiliently urging said shoe element into contact engagement with said peripheral surface of said roller.

3. The adhesive apparatus according to claim 2, wherein heating means are operatively connected to said device for heating a quantity of hot melt adhesive provided for the applicator.

* * * * *